US006373174B1

(12) United States Patent
Talin et al.

(10) Patent No.: US 6,373,174 B1
(45) Date of Patent: Apr. 16, 2002

(54) FIELD EMISSION DEVICE HAVING A SURFACE PASSIVATION LAYER

(75) Inventors: Albert Alec Talin, Scottsdale; Curtis D. Moyer; Kenneth A. Dean, both of Phoenix; Jeffrey H. Baker, Chandler; Steven A. Voight, Gilbert, all of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/459,119

(22) Filed: Dec. 10, 1999

(51) Int. Cl.[7] ..... H01J 1/02

(52) U.S. Cl. ..... 313/309; 313/310; 313/351; 313/495; 313/497; 445/24

(58) Field of Search ..... 313/495, 496, 313/497, 309, 293, 296, 326, 336, 351; 445/24

(56) References Cited

U.S. PATENT DOCUMENTS

| | | | | | |
|---|---|---|---|---|---|
| 4,041,316 | A | | 8/1977 | Todokoro et al. | 250/396 R |
| 4,931,693 | A | | 6/1990 | Gally et al. | 313/528 |
| 4,947,081 | A | * | 8/1990 | Ohiwa et al. | 313/509 |
| 5,090,932 | A | * | 2/1992 | Dieumegard et al. | 445/24 |
| 5,668,437 | A | | 9/1997 | Chadha et al. | 313/495 |
| 5,712,534 | A | * | 1/1998 | Lee et al. | 313/309 |
| 5,717,285 | A | | 2/1998 | Meyer et al. | 313/495 |
| 5,719,406 | A | | 2/1998 | Cisneros et al. | 257/10 |
| 5,731,246 | A | * | 3/1998 | Bakeman, Jr. et al. | 438/770 |
| 5,760,535 | A | | 6/1998 | Moyer et al. | 313/309 |
| 5,776,540 | A | | 7/1998 | Chadha et al. | 427/126.3 |
| 5,929,560 | A | | 7/1999 | Trujillo et al. | 313/495 |
| 5,975,975 | A | * | 11/1999 | Hofmann et al. | 445/24 |
| 6,064,149 | A | * | 5/2000 | Raina | 313/497 |
| 6,100,195 | A | * | 8/2000 | Chan et al. | 438/687 |
| 6,108,210 | A | * | 8/2000 | Chung | 361/747 |
| 6,124,179 | A | * | 9/2000 | Adamic, Jr. | 438/309 |

FOREIGN PATENT DOCUMENTS

| | | |
|---|---|---|
| EP | 0616356 | 9/1994 |
| EP | 0660358 | 6/1995 |
| EP | 0660362 | 6/1995 |
| EP | 0668603 | 8/1995 |
| EP | 0696042 | 2/1996 |
| EP | 0840344 | 5/1998 |
| WO | 9742644 | 11/1997 |
| WO | 9940604 | 8/1999 |

* cited by examiner

*Primary Examiner*—Nimeshkumar D. Patel
*Assistant Examiner*—Mariceli Santiago
(74) *Attorney, Agent, or Firm*—Kevin D. Wills; William E. Koch

(57) ABSTRACT

A field emission device (100, 200, 300, 400, 500) includes a substrate (110, 210, 310, 410, 510), a cathode (115, 215, 315, 415, 515) formed thereon, a plurality of electron emitters (170, 270, 370, 470, 570) and a plurality of gate electrodes (150, 250, 350, 450, 550) proximately disposed to the plurality of electron emitters (170, 270, 370, 470, 570) for effecting electron emission therefrom, a dielectric layer (140, 240, 340, 440, 540) having a major surface (143, 243, 343, 443, 543), a surface passivation layer (190, 290, 390, 490, 590) formed on the major surface (143, 243, 343, 443, 543), and an anode (180, 280, 380, 480, 580) spaced from the gate electrodes (250, 350, 450, 550).

23 Claims, 2 Drawing Sheets

FIELD EMISSION DEVICE HAVING A SURFACE PASSIVATION LAYER

FIELD OF THE INVENTION

The present invention pertains to field emission devices and, more particularly, to field emission devices having a surface passivation layer.

BACKGROUND OF THE INVENTION

Field emission devices (FED's) are known in the art. In a field emission device, electrons are emitted from a cathode and strike an anode liberating gaseous species. Emitted electrons also tend to strike gaseous species already present in the FED and form positively charged ions. The ions within the FED are repelled from the high positive potential of the anode and are caused to strike portions of the cathode. Those positive ions striking the dielectric layer portion of the cathode can be retained therein, resulting in a build up of positive potential. The build up of positive potential continues until either the dielectric layer breaks down due to the realization of the breakdown potential of the dielectric material, or until the positive potential is high enough to deflect electrons toward, and cause them to strike the dielectric layer. Ions can also strike electron emitters within the FED causing emitter damage and degrading FED performance.

Impinging ions can also liberate trapped gases within the dielectric layer and release oxygen due to chemical dissociation of the dielectric layer. Also, impinging ions can combine with elements within the dielectric layer to create additional gases, thereafter releasing them into the FED. Additionally, impinging ions can strike metal electrodes and liberate gases from the oxide coating the metal electrode thereby releasing gases into the FED. Other surfaces within the FED are potential sources of gas due to impinging electrons as well.

Accordingly, there exists a need for a field emission device having a structure and method that protects exposed dielectric surfaces within the device from electron and ion bombardment, prevents the liberation of trapped gases within the dielectric layer and traps bombarding ions within the device.

BRIEF DESCRIPTION OF THE DRAWINGS

Referring to the drawings.

DETAILED DESCRIPTION

An embodiment of the invention is for a field emission device incorporating a surface passivation layer to protect inner dielectric surfaces. An embodiment of the invention can also incorporate a charge bleed layer to remove accumulating charge on the dielectric surface. An embodiment of the method of the invention includes placing a surface passivation layer on exposed dielectric surfaces within a field emission device.

There are numerous advantages to the invention and the method of the invention including the protection of exposed dielectric surfaces within a field emission device from electron and ion bombardment. Surface passivation layer 190 is impervious to chemical dissociation from impinging ions and the associated release of deleterious gases such as oxygen and the like. This has the advantage of preventing the breakdown of dielectric layer due to breakdown of dielectric material. This also has the advantage of preventing both the chemical dissociation of the dielectric layer and the release of trapped gases such as $O_2$, $H_2O$, CO, $CO_2$, and the like from escaping into the FED. These oxygenated gases can cause further damage to other components of the FED including electron emission structures and the like. Together, these advantages extend the lifetime of a FED by preventing catastrophic arcing within the device and electron emitter degradation. Yet another advantage of the invention is the trapping of positively charged ions by the surface passivation layer in order to reduce the residual gas loading within the field emission device.

Figure 1:
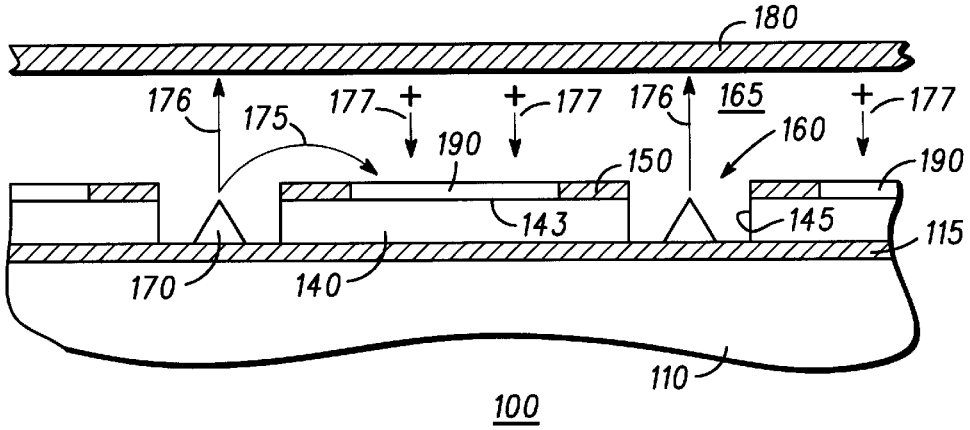
FIG. 1 is a cross-sectional view of a field emission device in accordance with an embodiment of the invention.

FIG. 1 is a cross-sectional view of a field emission device in accordance with an embodiment of the invention. FED 100 includes a substrate 110, which can be made from glass, such as borosilicate glass, silicon, and the like. FED 100 further includes a plurality of gate electrodes 150, which are spaced from a cathode 115 by a dielectric layer 140.

Cathode 115 includes a layer of a conductive material, such as molybdenum, which is deposited on substrate 110. Dielectric layer 140, made from a dielectric material such as silicon dioxide, electrically isolates gate electrodes 150 from cathode 115. Spaced from gate electrodes 150 is an anode 180, which is made from a conductive material, thereby defining an interspace region 165. Interspace region 165 is typically evacuated to a pressure below $10^{-6}$ Torr. Dielectric layer 140 has vertical surfaces 145, which define emitter wells 160. A plurality of electron emitters 170 are disposed, one each, within emitter wells 160 and can include Spindt tips. Dielectric layer 140 also includes a major surface 143. Gate electrodes 150 are disposed on a portion of major surface 143. Remaining portions of the major surface 143 of dielectric layer 140 are exposed to interspace region 165.

During the operation of FED 100, and as is typical of triode operation in general, suitable voltages are applied to gate electrodes 150, cathode 115, and anode 180 for selectively extracting electrons from electron emitters 170 and causing them to be directed toward anode 180. A typical voltage configuration includes an anode voltage within the range of 100–10,000 volts; a gate electrode voltage within a range of 10–100 volts; and a cathode potential below about 10 volts, typically at electrical ground. Emitted electrons strike anode 180, liberating gaseous species therefrom. Along their trajectories from electron emitters 170 to anode 180, emitted electrons also strike gaseous species, some of which originate from anode 180, present in interspace region 165. In this manner, positively charged ions are created within interspace region 165, as indicated by encircled "+" symbols in FIG. 1.

When FED 100 is incorporated into in a field emission display, anode 180 has deposited thereon a cathodoluminescent material which, upon receipt of electrons, is caused to emit light. Upon excitation, common cathodoluminescent materials tend to liberate substantial amounts of gaseous species, which are also vulnerable to bombardment by electrons to form positively charged ions. Positive ions within interspace region 165 are repelled from the high positive potential of anode 180, as indicated by the arrows 177 in FIG. 1, and are caused to strike plurality of gate electrodes 150 and major surface 143 of dielectric layer 140. Those striking plurality of gate electrodes 150 are bled off as gate current; those striking major surface 143 of dielectric layer 140 are retained therein, resulting in a build up of positive potential. This build up of positive potential on the major surface 143 continues until either dielectric layer 140 breaks down due to the realization thereover of the breakdown potential of the dielectric material, which is typically in the range of 300–500 volts, or until the positive potential is high enough to deflect (indicated by an arrow 175 in FIG. 1) electrons toward the major surface 143 of dielectric layer 140.

In accordance with an embodiment of the present invention, a surface passivation layer 190 is formed on major surface 143 of dielectric layer 140. Surface passivation layer 190 is made from a material having a sheet resistance greater than $10^6$ ohms per square. In the embodiment of FIG. 1, surface passivation layer 190 can be made of nitrides with negligible oxide content, for example, tantalum nitride, tantalum oxynitride, and the like, diamond-like carbon, and combinations of non-oxide forming metals and nitrides with oxide-free surfaces, for example, silicon nitride, aluminum nitride, and the like. However, any material within the above range of sheet resistance and having suitable film characteristics can be employed. Suitable film characteristics include adequate adhesion to the major surface 143 of dielectric layer 140 and resistance toward subsequent processing steps.

Surface passivation layer 190 precludes the impingement of positively charged ions and electrons onto major surface 143 of dielectric layer 140. This prevents the breakdown of dielectric layer 140 due to breakdown of dielectric material, prevents gases trapped within dielectric layer 140 from escaping and prevents the chemical dissociation of dielectric layer 140 which leads to the release of deleterious gases into FED 100. Surface passivation layer 190 traps impinging positively charged ions within FED 100 to reduce residual gas loading and is impervious to chemical dissociation from impinging ions and the associated release of deleterious gases such as oxygen and the like. In addition, surface passivation layer 190 prevents impinging ions from combining with elements within dielectric layer 140 to create additional gases. These advantages extend the life of FED 100 by reducing the number of ions within FED 100 and the electron emitter 170 degradation associated with collisions of positively charged ions with electron emitters 170.

The fabrication of FED 100 includes standard methods of forming a Spindt tip field emission device and further includes adding a deposition step wherein a layer of the material comprising surface passivation layer 190, such as tantalum nitride, tantalum oxynitride, diamond-like carbon, and the like, is deposited upon the dielectric layer which is formed on cathode 215. Surface passivation layer 190 can be deposited by sputtering or plasma-enhanced chemical vapor deposition (PECVD) to a thickness within a range of 20–2000 angstroms. Standard deposition and patterning techniques may be employed to form the plurality of gate electrodes 150, emitter wells 160 and electron emitters 170.

Figure 2:
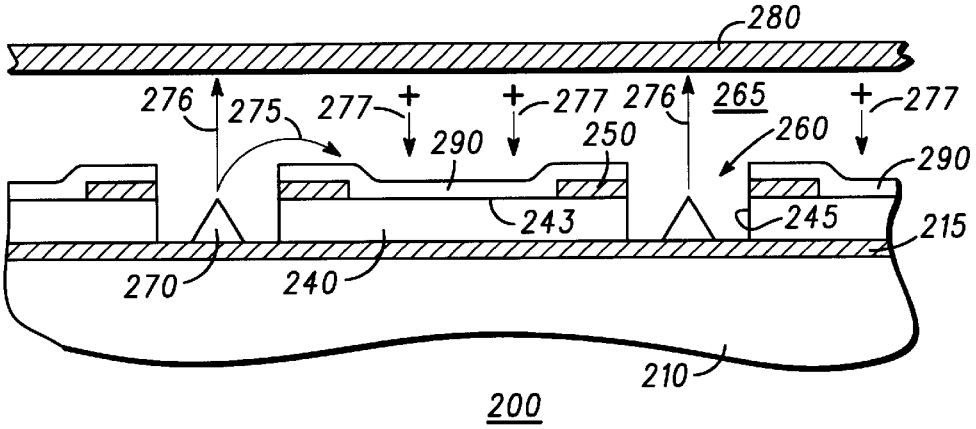
FIG. 2 is a cross-sectional view of a field emission device in accordance with another embodiment of the invention.

FIG. 2 is a cross-sectional view of a field emission device 200 in accordance with another embodiment of the invention. FIG. 2 includes the elements of FED 100 (FIG. 1), which are similarly referenced, beginning with a "2." In this embodiment, surface passivation layer 290 is deposited subsequent to the formation of a plurality of gate electrodes 250 and covers the plurality of gate electrodes 250 and is aligned with the edge of the plurality of gate electrodes 250. For example, when the surface passivation layer 290 is etched in the same mask sequence as that forming emitter wells, their well-side edges are aligned. In an alternate embodiment, surface passivation layer 290 can cover only a portion of each of the plurality of gate electrodes 250. Surface passivation layer 290 can be deposited by evaporation subsequent the etching of the emitter wells 260. This reduces the number of processing steps to which surface passivation layer 290 is exposed during subsequent its formation. An advantage provided by surface passivation layer 290 is the protection of metal electrodes from impinging ions and the associated release of gases into the FED 200.

Figure 3:
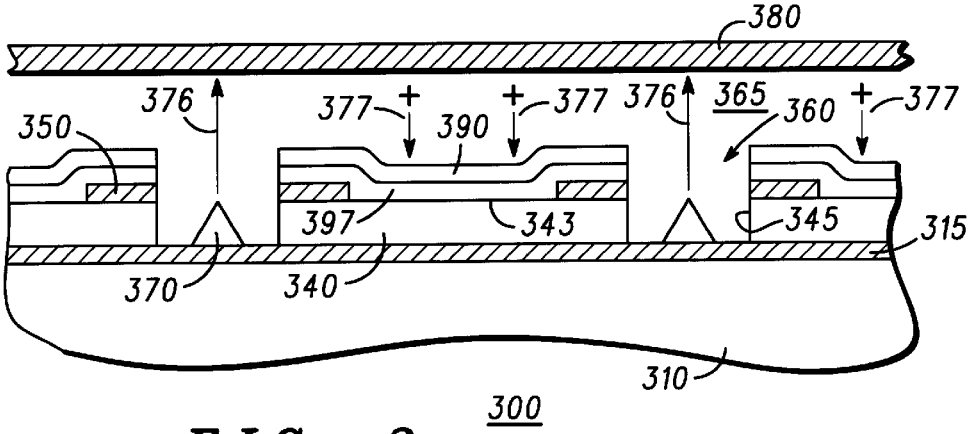
FIG. 3 is a cross-sectional view of a field emission device in accordance with yet another embodiment of the invention.

FIG. 3 is a cross-sectional view of a field emission device 300 in accordance with yet another embodiment of the invention. FIG. 3 includes the elements of FED 200 (FIG. 2), which are similarly referenced, beginning with a "3." In this embodiment, FED 300 further includes a charge bleed layer 397, in accordance with the present invention. Charge bleed layer 397 is disposed between dielectric layer 340 and surface passivation layer 390. Surface passivation layer 390 has properties, which allow it to conduct current toward charge bleed layer 397 beneath it. The electrical sheet resistance provided by charge bleed layer 397 is predetermined to effect the conduction of positively charged species which impinge upon it, thereby preventing the accumulation of positive surface charge during operation of FED 300. The sheet resistance of charge bleed layer 397 can be made high enough to prevent shorting, and excessive power loss, between gate electrodes 350 while still adequate to conduct and bleed-off impinging charges.

Charge bleed layer 397 is made from a material having a sheet resistance within a range of $10^9$–$10^{12}$ ohms per square and a thickness within a range of 100–5000 angstroms. It can be made from amorphous silicon, conductive oxides, and the like, however, any material within the above range of sheet resistances can be employed. Surface passivation layer 390 with underlying charge bleed layer 397 can be fabricated using the techniques of masking and etching described above and both layers can cover either a portion or the entire of each of the plurality of gate electrodes 350.

Figure 4:
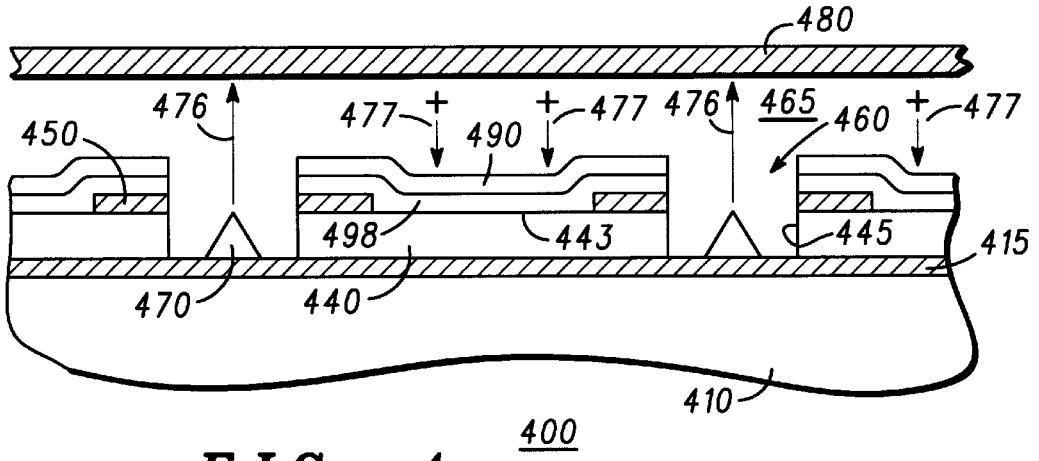
FIG. 4 is a cross-sectional view of a field emission device in accordance with still another embodiment of the invention.

FIG. 4 is a cross-sectional view of a field emission device 400 in accordance with still another embodiment of the invention. FIG. 4 includes the elements of FED 300 (FIG. 3), which are similarly referenced, beginning with a "4." In this embodiment, FED 400 further includes an insulating layer 498, in accordance with the present invention. Insulating layer 498 is disposed between dielectric layer 440 and surface passivation layer 490. Because surface passivation layer 490 does not provide ohmic contact between gate extraction electrodes 450, its sheet resistance and thickness can be made as such to act as both a surface passivation layer and a charge bleed layer. Sheet resistance can be made lower than that of embodiments described with reference to FIGS. 1–3. Thus a wider range of materials can be employed to form surface passivation layer 490. For example, in this embodiment, thickness of surface passivation layer 490 can be within a range of 100–50,000 angstroms and can include those materials cited in the above embodiments, along with additional materials including, for example, a noble metal, an oxide-free metal, for example, gold, and the like. This embodiment of the present invention provides the benefit of passivating the major surface 443 of dielectric layer 430 and bleeding off excess charge, all with a single layer, potentially reducing the number of fabrication steps required in forming the FED 400. This also provides the benefit of very low leakage currents between gate electrodes 450. To bleed the charge out of FED 400, surface passivation layer 490 is independently connected to a grounded electrical contact external FED 400, as illustrated in FIG. 4 thereby providing an independent conduction path for the surface charge. Insulating layer 498 can be made from silicon dioxide, silicon nitride, and the like, to electrically isolate surface passivation layer 490 from plurality of gate electrodes 450. Surface passivation layer 490 with underlying insulating layer 498 can be fabricated using the techniques of masking and etching described above and both layers may cover either a portion or the entire of each of the plurality of gate electrodes 350.

Figure 5:
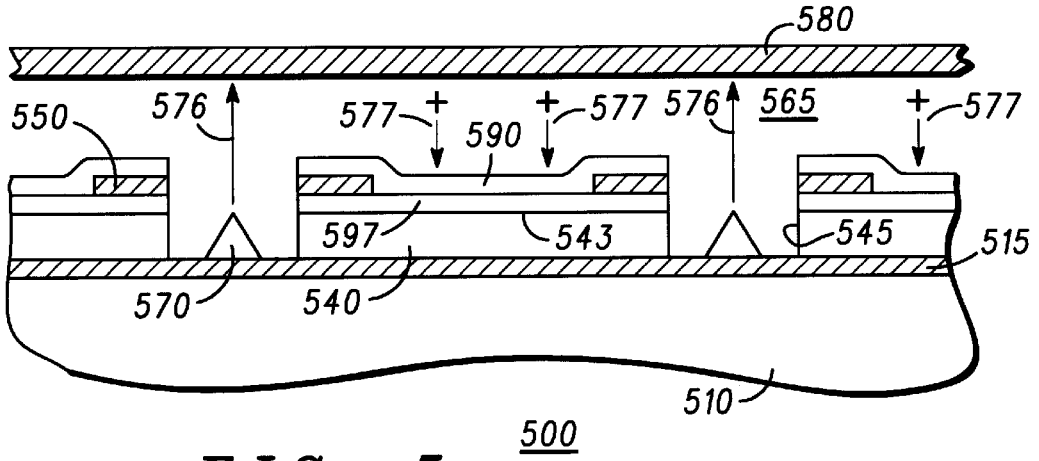
FIG. 5 is a cross-sectional view of a field emission device in accordance with still yet another embodiment of the invention.

FIG. 5 is a cross-sectional view of a field emission device 500 in accordance with still yet another embodiment of the invention. FIG. 5 includes the elements of FED 400 (FIG. 4), which are similarly referenced, beginning with a "5." In this embodiment, FED 500 further includes a charge bleed layer 597 as in FIG. 3, except charge bleed layer 597 is disposed beneath plurality of gate electrodes 550 on major surface 543 of dielectric layer 540. Surface passivation layer 590 is disposed on charge bleed layer 597 and plurality of gate electrodes 550. Surface passivation layer 590 can also be disposed on only a portion of each of the plurality of gate electrodes 550.

A field emission device in accordance with the present invention may include electron emitters other than Spindt tips. Other electron emitters include, but are not limited to, edge emitters and surface/film emitters. Edge and surface emitters may be made from field emissive materials, such as carbon-based films including diamond-like carbon, non-crystalline diamond-like carbon, diamond, and aluminum nitride. All dielectric surfaces within these field emission devices, which are not otherwise covered by electrodes of the device, may be covered by a surface passivation layer, in accordance with the present invention, to protect dielectric layer, prevent the release of gases from dielectric layer, and to trap bombarding positively charged ions. Similarly, a field emission device in accordance with the present invention can include electrode configurations other than a triode, such as diode and tetrode. A surface passivation layer in accordance with the present invention can also be formed on a dielectric surface adjacent the outermost electron emitters in an array of electron emitters; these peripheral dielectric surfaces may not include portions of the device electrodes, but they nevertheless are susceptible to surface charging and dielectric breakdown from ion and electron bombardment.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

What is claimed is:

1. A field emission device comprising:

a substrate;

a plurality of electron emitters supported by the substrate, wherein the plurality of electron emitters emit electrons;

a dielectric layer disposed on the substrate, wherein the dielectric layer has a major surface, and wherein the major surface is proximately disposed to the plurality of electron emitters;

a surface passivation layer that is impervious to chemical disassociation from impinging ions, electrons, and associated release of deleterious gases and including electron and ion passivating properties disposed on the major surface of the dielectric layer, wherein the surface passivation layer protects the dielectric layer against electron and ion bombardment, and wherein the surface passivation layer is comprised of at least one of: tantalum nitride, tantalum oxynitride, diamond-like carbon or a noble metal; and an anode spaced apart from the substrate and disposed to receive electrons emitted by the plurality of electron emitters.

2. The field emission device as claimed in claim 1, further comprising a charge bleed layer disposed on the major surface of the dielectric layer, wherein the charge bleed layer is disposed between the dielectric layer and the surface passivation layer.

3. The field emission device as claimed in claim 1, wherein the surface passivation layer has a sheet resistance greater than $10^6$ ohms per square.

4. The field emission device as claimed in claim 1, wherein the surface passivation layer is comprised of silicon nitride.

5. The field emission device as claimed in claim 1, wherein the surface passivation layer is comprised of aluminum nitride.

6. The field emission device as claimed in claim 1, further comprising an insulating layer, wherein the insulating layer is disposed between the dielectric layer and the surface passivation layer.

7. The field emission device as claimed in claim 6, wherein the surface passivation layer is comprised of an oxide-free metal.

8. A field emission device comprising:

a substrate;

a plurality of electron emitters supported by the substrate, wherein the plurality of electron emitters emit electrons;

a dielectric layer disposed on the substrate, wherein the dielectric layer has a major surface, and wherein the major surface is proximately disposed to the plurality of electron emitters;

a plurality of gate electrodes proximate to the plurality of electron emitters and supported by the dielectric layer;

a surface passivation layer that is impervious to chemical disassociation from impinging ions, electrons, and associated release of deleterious gases and including electron and ion passivating properties disposed on the major surface of the dielectric layer, wherein the surface passivation layer protects the dielectric layer against electron and ion bombardment, and wherein the surface passivation layer is comprised of at least one of: tantalum nitride, tantalum oxynitride, diamond-like carbon or a noble metal; and an anode spaced apart from the substrate and disposed to receive electrons emitted by the plurality of electron emitters.

9. The field emission device as claimed in claim 8, wherein the surface passivation layer is disposed on at least a portion of the plurality of gate electrodes.

10. The field emission device as claimed in claim 8, further comprising a charge bleed layer, wherein the charge bleed layer is disposed between the dielectric layer and the surface passivation layer.

11. The field emission device as claimed in claim 8, wherein the surface passivation layer has a sheet resistance greater than $10^6$ ohms per square.

12. The field emission device as claimed in claim 8, wherein the surface passivation layer is comprised of silicon nitride.

13. The field emission device as claimed in claim 8, wherein the surface passivation layer is comprised of aluminum nitride.

14. The field emission device as claimed in claim 8, further comprising an insulating layer, wherein the insulating layer is disposed between the dielectric layer and the surface passivation layer.

15. The field emission device as claimed in claim 14, wherein the surface passivation layer is comprised of an oxide-free metal.

16. A method of passivating a dielectric surface within a field emission device comprising the steps of:

providing a substrate;

providing a plurality of electron emitters supported by the substrate, wherein the plurality of electron emitters emit electrons;

providing a dielectric layer disposed on the substrate, wherein the dielectric layer has a major surface, and wherein the major surface is proximately disposed to the plurality of electron emitters;

placing a surface passivation layer that is impervious to chemical disassociation from impinging ions, electrons, and associated release of deleterious gases and including electron and ion passivation properties on the major surface of the dielectric layer, wherein the surface passivation layer protects the dielectric layer against electron and ion bombardment, and wherein the surface passivation layer is comprised of at least one of: tantalum nitride, tantalum oxynitride, diamond-like carbon or a noble metal; and providing an anode spaced apart from the substrate and disposed to receive electrons emitted from the plurality of electron emitters.

17. The method of passivating a dielectric surface as claimed in claim 16, further providing a plurality of gate electrodes proximate to the plurality of electron emitters and supported by the dielectric layer.

18. The method of passivating a dielectric surface as claimed in claim 17, wherein the step of placing the surface passivation layer further comprises placing the surface passivation layer on at least a portion of the plurality of gate electrodes.

19. The method of passivating a dielectric surface as claimed in claim 16, further including the step of having the surface passivation layer have a sheet resistance greater than $10^6$ ohms per square.

20. The method of passivating a dielectric surface as claimed in claim 16, further including having the surface passivation layer comprised of silicon nitride.

21. The method of passivating a dielectric surface as claimed in claim 16, further including having the surface passivation layer comprised of aluminum nitride.

22. The method of passivating a dielectric layer as claimed in claim 16, further comprising the step of placing an insulating layer between the dielectric layer and the surface passivation layer.

23. The method of passivating a dielectric layer as claimed in claim 22, further including having the surface passivation layer comprised of an oxide-free metal.

* * * * *